US010016328B1

(12) United States Patent
Treat et al.

(10) Patent No.: US 10,016,328 B1
(45) Date of Patent: Jul. 10, 2018

(54) PLATFORM VIBRATION GENERATOR

(71) Applicant: Global Manufacturing, Inc., Little Rock, AR (US)

(72) Inventors: Rodney D Treat, Benton, AR (US); Stanislav P Kligman, Little Rock, AR (US); Thomas A Janosky, Little Rock, AR (US)

(73) Assignee: Global Manufacturing Inc., Little Rock, AR (US)

( * ) Notice: Subject to any disclaimer, the term of this patent is extended or adjusted under 35 U.S.C. 154(b) by 525 days.

(21) Appl. No.: 14/690,880

(22) Filed: Apr. 20, 2015

Related U.S. Application Data

(60) Provisional application No. 61/982,983, filed on Apr. 23, 2014.

(51) Int. Cl.
*A61H 1/00* (2006.01)
*A61H 23/02* (2006.01)

(52) U.S. Cl.
CPC ..... *A61H 1/005* (2013.01); *A61H 23/02* (2013.01); *A61H 1/001* (2013.01); *A61H 1/003* (2013.01); *A61H 2201/0138* (2013.01)

(58) Field of Classification Search
CPC ..... A61H 1/001; A61H 1/003; A61H 1/005; A61H 23/02; A61H 2201/0138; A61H 2201/0157; A61H 2201/0161
See application file for complete search history.

(56) References Cited

U.S. PATENT DOCUMENTS

| | | | | |
|---|---|---|---|---|
| 3,233,474 | A | 2/1966 | Ross | |
| 3,540,439 | A | 11/1970 | Hueftle, Jr. | |
| 3,815,404 | A * | 6/1974 | Brisard | G01M 17/04 73/11.08 |
| 4,153,227 | A * | 5/1979 | Gamaunt | F16F 9/0418 248/575 |
| 4,270,396 | A | 6/1981 | Fallows | |
| 4,614,123 | A | 1/1986 | Tompkins | |
| 4,967,737 | A | 11/1990 | Bassett | |
| 5,443,439 | A | 8/1995 | Ohshita | |
| 5,484,388 | A | 1/1996 | Bassett | |
| 6,106,491 | A * | 8/2000 | Gianutsos | A61H 1/0237 601/101 |
| 6,244,815 | B1 | 6/2001 | Treat | |
| 6,659,918 | B2 | 12/2003 | Schiessl | |
| 7,354,406 | B2 | 4/2008 | Kim | |
| 7,390,287 | B2 | 6/2008 | Wu | |
| 7,530,960 | B2 | 5/2009 | Cook | |

(Continued)

*Primary Examiner* — Timothy Stanis
(74) *Attorney, Agent, or Firm* — Stephen D. Carver

(57) ABSTRACT

A vibrator comprises an upper, lightweight, honeycomb rocker plate suspended above a rigid, lower base by a pair of triangular truss rocker arms. A pair of rigid, parallel, spaced-apart stringers within the vibrator rise upwardly from the lower base. A rocker shaft extending between the stringers pivots the rocker arms near their midpoint. A motor secured to the base within the vibrator drives a spaced-apart flywheel assembly that is mounted with a crankshaft journaled between the stringers. The motor is coupled to the flywheel assembly with a drive belt extending between suitable pulleys. The flywheel assembly crankshaft terminates in spaced apart, offset portions that reciprocate connecting rods linked to one end of the triangular truss rocker arms that vigorously vibrate the rocker plate.

12 Claims, 11 Drawing Sheets

(56) References Cited

U.S. PATENT DOCUMENTS

| | | | | |
|---|---|---|---|---|
| 7,705,500 | B2 | 4/2010 | Mills | |
| 7,726,194 | B2 | 6/2010 | Ma | |
| D624,611 | S | 9/2010 | Torres Martin | |
| 2007/0100260 | A1* | 5/2007 | Chiang | A61H 1/003 601/49 |
| 2007/0259758 | A1* | 11/2007 | Zeng | A61H 1/003 482/79 |
| 2008/0114275 | A1* | 5/2008 | Wu | A61H 1/001 601/27 |
| 2008/0171639 | A1* | 7/2008 | Hahn | A61H 1/003 482/52 |
| 2011/0083944 | A1 | 4/2011 | Bonn | |
| 2012/0208684 | A1* | 8/2012 | Huang | A61H 1/005 482/146 |
| 2013/0079196 | A1* | 3/2013 | Frey | A61H 1/003 482/4 |

* cited by examiner

PLATFORM VIBRATION GENERATOR

CROSS REFERENCE TO RELATED APPLICATION

This application is based upon, and claims priority from, previously filed U.S. Provisional Application Ser. No. 61/982,983, entitled "Platform Vibration Generator", filed 23 Apr. 2014, inventor Rodney D. Treat.

BACKGROUND OF THE INVENTION

I. Field of the Invention

The present invention relates generally to motor-driven vibrator apparatus. More particularly, the present invention relates to electrically powered, vibrating platforms of the type used with various exercise machines, medical treatment apparatus, and vibration test stands and equipment.

II. Description of the Prior Art

A variety of vibration-producing machines utilized for diverse purposes exist in the art. Many modern appliances and critical devices and machines used in aeronautics and aviation, electrical power generation, and with automotive applications, are routinely subject to vibration and shock testing. Existing vibration testing standards are widely accepted and applied. Standards exist to guide or govern vibration monitoring and analysis, including some that establish classifications for machinery vibration, how measurements should be made, and how the acquired data should be analyzed. In the field of machinery vibration monitoring and analysis, a variety of relevant standards are developed and published by ISO (International Organization for Standardization). In addition to ISO, various trade organizations such as the National Electrical Manufacturers Association (NEMA), and American Petroleum Institute (API), have developed and published vibration standards, which are widely accepted and applied. A variety of machines exist for applying vibration in accordance with predefined testing standards. For example, U.S. Pat. No. 7,726,194 issued Jun. 1, 2010 shows a vibration test device for an electronic test platform capable of vibrating along multiple directions, at various frequencies.

Some industrial machines depend on vibration for their function. For example, vibratory conveyors are widely used for material handling applications such as conveying, feeding or screening particulate materials. Typical existing designs employ a longitudinally-extending, material-conveying deck, tray or trough supported on leaf or coil springs mounted on a base which itself is fixed or spring-mounted. A motor-driven, eccentric drive device or other source of vibration imparts vibratory movement to the deck or tray. Typically, vibration is maintained by coil springs connected to the base. The vibratory movement of the deck helps to convey particulate material processed as it travels along the deck surface.

U.S. Application No. 20110083944, published Apr. 14, 2011, discloses a balanced vibrating conveyor employing a torsion bar spring and a rocker arm. The design provides synchronized 180 degree, out-of-phase vibrations with various stroke lengths. With a torsion bar spring at the rocker arm node point, dynamic forces are minimized in the conveyor frame, as well as the building support structure.

Other industrial vibrators, believed of less relevance, that are owned by Global Manufacturing Co. Inc., the same assignee as in this case, include U.S. Pat. No. 4,270,396 entitled "Vibrator" issued Jun. 2, 1981, U.S. Pat. No. 4,614,123 entitled "Vertical Vibrator" by inventor L. Kirk Tompkins, issued Sep. 30, 1986, and U.S. Pat. No. 6,244,815 issued Jun. 12, 2001, and entitled "High Efficiency Terry Turbine Motor and Vibrator," by inventor Rodney D. Treat, all of which are cited for purposes of disclosure.

Vibration or shaker machines are also popular with various exercise and physical conditioning equipment. It is well recognized that adequate exercise ensures better blood circulation and improved health. Relatively recently, various vibrating machines aimed at the "passive exercise" trend have been popularized. The latter fitness concept is based upon the concept of minimizing actual physical exertion while working out, by subjecting oneself to vibration in various forms. Popular, passive exercise trends include whole-body vibration, "chi" machines, electronic "ab stimulators," and massage therapy.

Currently, an extremely popular passive exercise category is whole-body vibration, also known as "Power Plate" exercise. Originating with programs used to train Russian cosmonauts, whole-body vibration became popular throughout Europe and Japan before generating acceptance in the United States and Asia. In the United States, exercise centers and health clubs exist that are devoted to this workout. In practice, most people stand on a vibrating platform with their knees bent slightly, while the surface beneath their feet oscillates at vibrational frequencies up to and exceeding thirty cycles per second.

Typical whole body vibration devices accelerate the human body by applying vibration through a platform. Simple whole body vibration devices transmit motion in only a vertical direction (i.e., up and down). More complex machines transmit motion in additional directions as well. Simple machines of the linear type transmit vibration to the human body through the feet, so both feet will be affected by impacts from the vibrating platform. "Side Alternating Devices" (SAD) have an agitator connected through a mechanical drive to a platform, and the users feet are not likely to lose contact with the platform during exercise, and impacts will be reduced. It is believed that such vibration tricks the participant into thinking that he or she is falling, activating the 'stress reflex,' thereby producing extremely rapid muscle contractions. These muscle contractions are thought to be responsible for most health benefits attributed to "Power Plate" exercises.

According to some manufacturers, additional health benefits include increased circulation and muscle strength, increased flexibility, better range of motion, core conditioning and stability, and faster muscle recovery after working out. Health benefits including enhanced metabolism, increased bone mineral density, reduction of the stress hormone cortisol, elevation of human growth hormone levels, and improved lymphatic flow have also been reported. Whole-body vibration is also said to reduce cellulite and to stimulate collagen production for smoother skin. It has also been suggested that whole-body vibration provides muscle toning and conditioning for those with health disabilities that prevent them from exercising, such as multiple sclerosis, Parkinson's disease, and some forms of arthritis.

A number of patents and references that relate generally to the above-discussed passive exercise trend exist. For example, U.S. Pat. No. 7,705,500 issued Apr. 27, 2010 discloses a vibration apparatus for vibrational massage therapy. A motor assembly generates vibrations of differing amplitudes utilizing a single motor to drive a shaft that, in turn, rotates an eccentric weight whose rotational axis is non-coaxial with the shaft's rotational axis. The reversal of the direction in which the motor rotates the shaft changes the amplitude of the resulting vibrations communicated to a platform. Thus, vibrational amplitude most suitable for a particular application or purpose may be selected.

Therapeutic vibration can also be experienced by the bedridden. U.S. Pat. No. 5,443,439 issued Aug. 22, 1995 shows a vibration apparatus that drives a bedstead mounted on a bedframe. The bedstead is divided into a plurality of separate pieces that are swingable on the bedframe. Rotational motion of a drive shaft is converted by a power transmitting device to an up and down motion, whereby the separation pieces are so driven as to be swingable over the bedframe.

U.S. Pat. No. 6,659,918 issued Dec. 9, 2003 shows a vibrating device for invoking a muscle's natural reflexes by imparting a sudden increase in load on the muscle over a defined period of time, with a predetermined amplitude. The muscle is stimulated by cycling the load with a frequency of between one and sixty Hz., with an amplitude of displacement of the muscle between two and fifty mm. The force input to the muscle can be provided by either the mass of the body to which the muscle is connected or by an external mass or resistance to motion. A seesaw platform can be oscillated in a vertical direction at the correct frequency and amplitude. Alternatively, a surface adapted to be fixed to a portion of the body can be oscillated relative to an external mass or other element that resists motion due to gravitational, frictional or inertial forces.

U.S. Pat. No. 7,354,406 issued Apr. 8, 2008 shows an exercising apparatus that functions by contracting and relaxing user's muscles. At least one rotary motion unit has a moving unit installed at one end thereof with a hinge, and an up-and-down reciprocating unit connected with the other end of the moving unit. The reciprocating unit makes the moving unit rotate in an angular interval. A driving unit is connected with the up-and-down reciprocating unit.

A shaking exerciser is illustrated in U.S. Pat. No. 7,390,287 issued Jun. 24, 2008. The latter reference discloses a base having twin supports between which a pivotable frame is connected. A side frame is connected to one of the two supports and has two rollers. A top pad is connected to a top of the pivotable frame and has an extension rod connected to a swing rod which extends through the support and extends between the two rollers. A driving device is connected to the base and has a link which is connected to the pivotable frame by an eccentric member so as to pivot the pivotable frame and the top pad. The extension rod on the top pad unit swings the swing rod to force the top pad to move in different directions.

U.S. Pat. No. 7,530,960 issued May 12, 2009 discloses a therapeutic vibration apparatus with a motor-driven vibrator mounted beneath a vibration platform. The motor drives a shaft on which a fixed weight is eccentrically mounted. The fixed weight includes a stop protruding outwardly. A rotatable weight is positioned on the drive shaft at a location to be caught by the stop when the shaft is rotating. A controller is used to change the direction of rotation of the motor so that when the motor is reversed the weight is caught on the other side of the drive shaft in opposition to the eccentric portion of the fixed weight.

Vibration is frequently used in various medical applications. For example, U.S. Pat. No. 4,967,737 issued Nov. 6, 1990 discloses a system for treating bone disorders by providing passive exercise for increasing the amount, strength and proper anatomical distribution of bone in a patient suffering from a bone disorder. The method involves determining various parameters using them to repeatedly lift the patient's heels and then allow the patient's heels to drop from the prescribed drop to impart the determined impact load. The method is effected by a device with a pivoting platform, a pivoting lift lever linked to the pivoting platform, a cam follower located at a free end of the lift lever, a cam engaging the cam follower, and a motor rotatably coupled to the cam.

The vibrational treatment of bone disorders is addressed in U.S. Pat. No. 5,484,388 issued Jan. 16, 1996. This reference shows a vibrating device that subjects a patient to the application of compressive preload and repetitive impacts. Preload is provided by gravity or compression. The impact load, impact rate, and a number of impacts determined by a physician prior to treatment are chosen to generate electrical signals in the patient's bone such that the majority of energy of the electrical signals lies between 0.1 Hz and 1 kHz, and the peak amplitude values of the electrical signals lie between 15 and 30 Hz.

Notwithstanding the many prior art efforts directed to vibrating platform or pedestal devices, there are recognized deficiencies in earlier efforts. Such devices must of course be safe and rugged and durable, as they must support and vibrate users with weights in the order of magnitude of hundreds of pounds. The vibration must also be controlled, and evenly distributed upon the pedestal that a user stands on, necessitating appropriate designs in the coupling linkage, usually operated by a rotating electric motor, that reciprocally rocks the user platform. One common design utilizes pillow blocks controlling rotating parts linked to platform rocking apparatus. With rugged, vibrating platform designs the desirable, user-perception of stiffness requires heavy-duty pillow blocks and linkages, for example, resulting in excessive or disadvantageous unit weight. Where the vibrating apparatus is designed to be lightweight, the user-desired "stiffness" will be lacking. Perceived stiffness is reduced by unbalanced rocking forces characterizing known lightweight designs. Unbalanced platform rocking occurs in known prior art, lightweight vibrating systems that displace the platform from a single side. Vibrating platform designs with single side drive are very difficult to dynamically balance.

What is needed is a vibrating platform system that combines characteristic stiffness with light weight. In other words, unbalanced forces must be minimized while maximizing stiffness. The key to success appears to be in the rocker linkage, whereby vibration is imparted to the platform.

SUMMARY OF THE INVENTION

This invention provides a vibrating platform suitable for use with a wide variety of applications that require substantial vibration. The device combines lightweight components with an operating stiffness.

Preferably a pair of spaced-apart lightweight, triangular trusses are pivoted above a support plate on opposite sides of a pair of parallel stringers. A lightweight, preferably honeycomb rocker plate is supported by the twin trusses to which it is fastened. Preferably the rocker plate includes an upper layer of strengthening aircraft honeycomb, reducing weight. To significantly reduce the required number of parts and thus further reduce the unit's weight, the platform trusses are driven only from one end of the vibrator, by driving linkage connected between a rotating motor and a single end of each rocker arm truss. Preferably the truss rocker arms are driven by a rotating crankshaft that mounts a flywheel assembly splined to it. Older, more complex units typically utilize a drive bar with a multi-component, synchronized drive system that directly displaces both ends of a rocker plate. Often, complex counterbalancing is required, as well as synchronizing components. A single side drive system is difficult to dynamically balance, but with a significantly lighter rocker arm there are less counterbalancing forces transmitted to the flywheel. This results in a stiffer and smoother-running machine. Also, effects of rocker arm weight are reduced because of the arm's truss geometry, since most of the truss mass is concentrated closer to the center of rotation of the arm than a simple bar arm would be, further reducing unbalanced forces.

Thus a basic object of this invention is to provide a reliable and effective vibration system for lightweight platform vibrator applications.

More particularly, a fundamental object of the invention is to combine perceived stiffness with a light weight vibrating platform.

A related object is to provide a vibration platform of the character described that reduces unbalanced forces while maintaining stiffness.

Similarly, it is an object to provide a vibrator station that provides vigorous vibration upwardly through an exercise pedestal or platform suitable for use in a variety of applications.

A related object is to provide a lightweight vibration platform of the character described that is ideal for use with various exercise and physical conditioning equipment, and which may find use with certain medical vibrating machines.

Another important object is to provide a vibrating platform of the character described that reduces the mass which must be displaced by the motor and the various linkages.

Conversely, an important object is to increase stiffness.

Another basic object is to provide a vibration source for exercising apparatus that stably supports the user's feet while providing a vigorous rocking motion.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
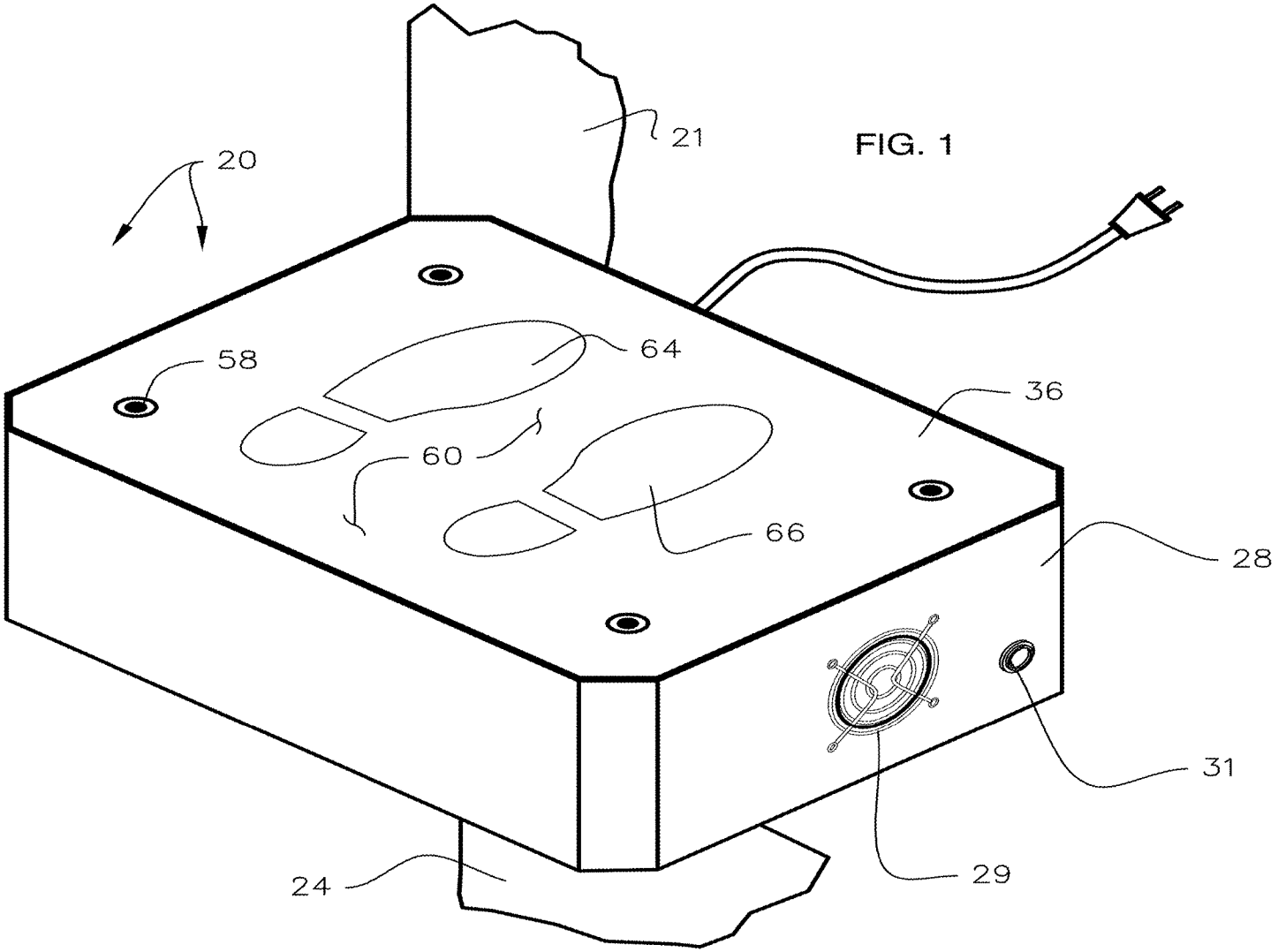
FIG. 1 is a fragmentary, isometric view of an assembled Platform Vibration Generator constructed in accordance with the best mode of the invention.
Figure 2:
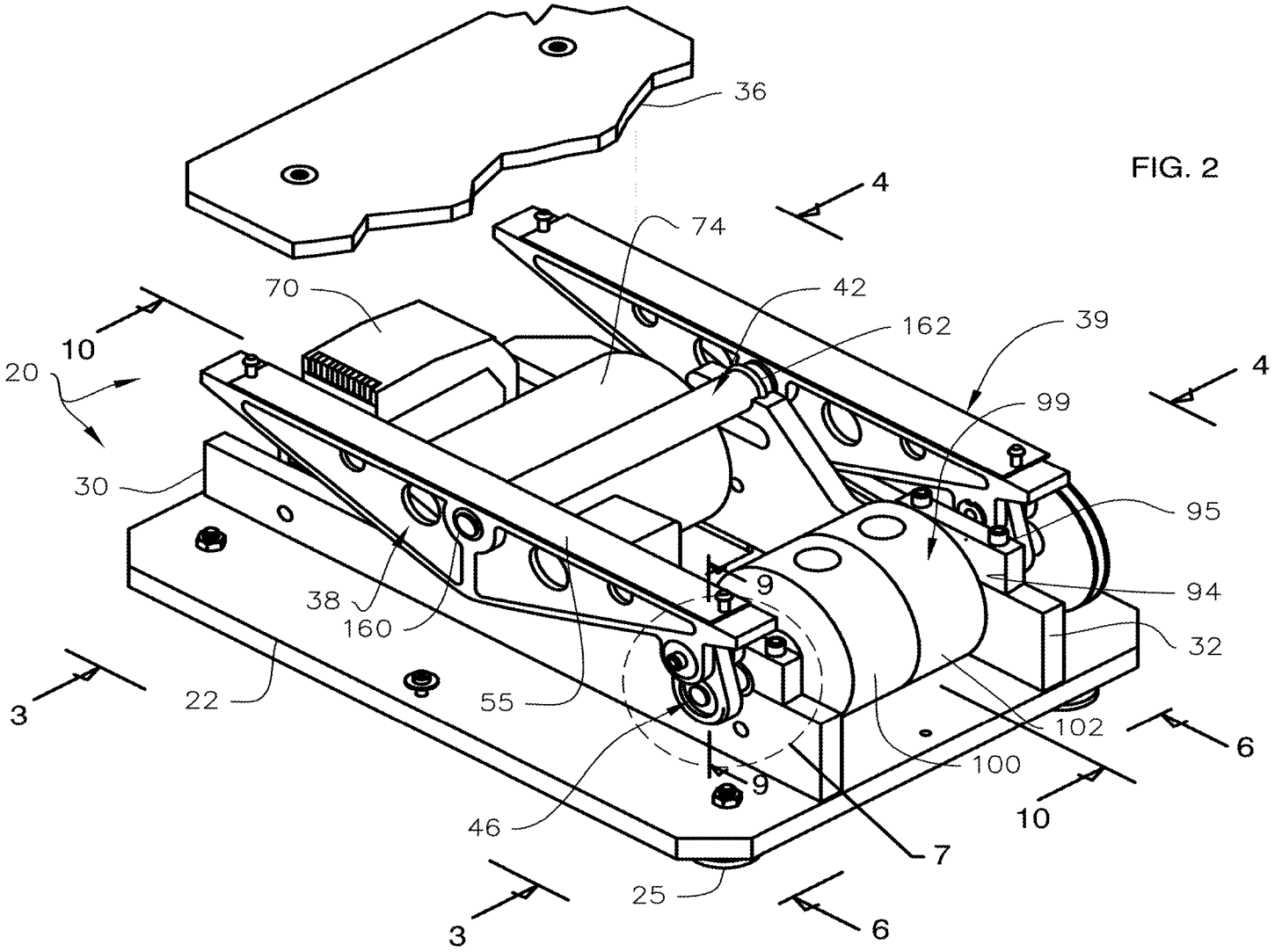
FIG. 2 is an enlarged, fragmentary, partially exploded isometric view of the invention with the cover removed, showing internal parts.
Figure 3:
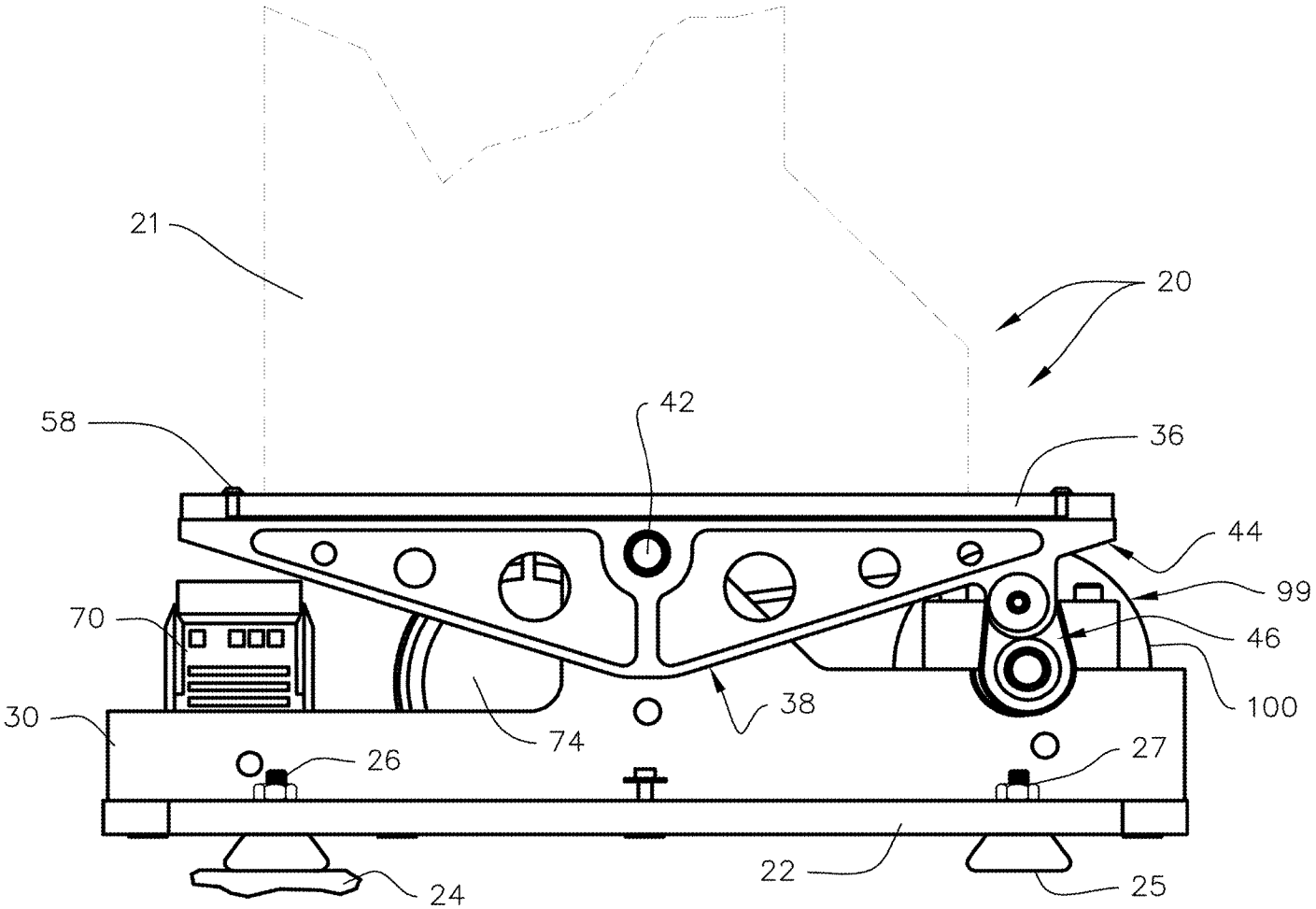
FIG. 3 is a fragmentary, front elevational view taken generally along line 3-3 in FIG. 2.

With initial reference now directed to FIGS. 1-3 of the appended drawings, a platform vibrator constructed in accordance with the best mode of the invention has been generally designated by the reference numeral 20. The preferred vibrator 20 is adapted to be employed with a variety of applications requiring firm, sustained vibration. For example, it is ideal for medical or exercise machines of the type including an upwardly rising, vertical stanchion 21 (FIG. 1) that may terminate somewhat below the eye level of a user, with handles, various controls, instruments or gauges, and computer screens or the like that are involved with a particular application. The vibrator 20 comprises a rigid, generally planar, lower base 22 (FIG. 2) in the form of a plate. Base 22 is adapted to be disposed upon a lower, supporting surface 24 (FIG. 1). Stable support may be provided by a plurality of adjustable feet 25 that may have through-bolts 26 fastened to base plate 22 by conventional fasteners 27 (FIG. 3). An upright, encircling, skirt 28 (FIG. 1) supported peripherally about the base 22 rises vertically upwardly therefrom to form an enclosure, shrouding the parts inside the vibrator. There is a fan vent grill 29 (FIG. 1) mounted within an appropriate orifice defined within the skirt 28. Grill 29 borders a fan impeller described later. A controller port 31 is disposed adjacent grill 29.

Figure 6:
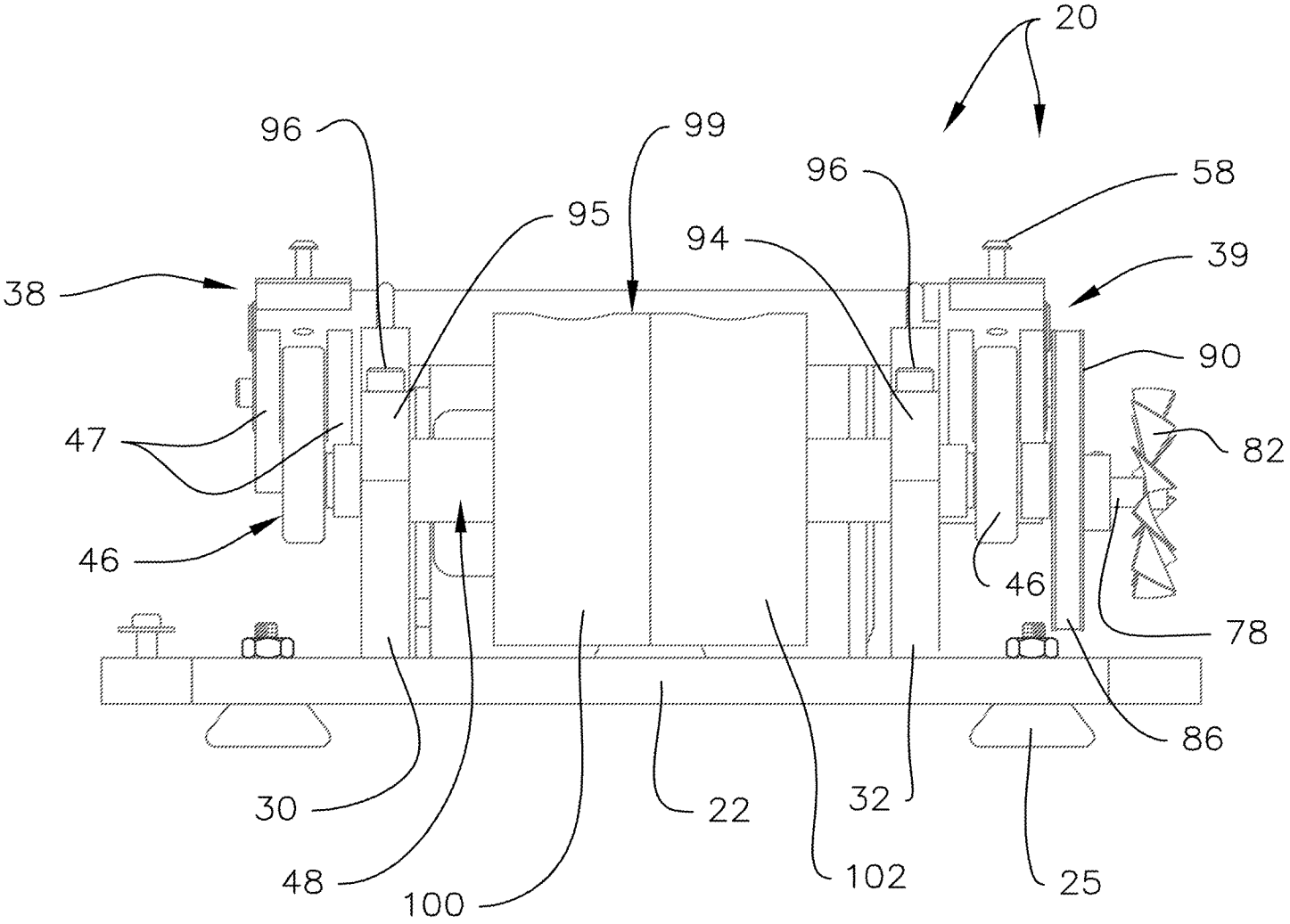
FIG. 6 is an enlarged, fragmentary, end view taken generally along line 6-6 in FIG. 2.

A pair of rigid, spaced apart, parallel stringers 30 (FIGS. 2, 3) and 32 (FIGS. 2, 4) are disposed upon base plate 22, and rise vertically upwardly therefrom. Stringers 30 and 32 support a transversely mounted rocker shaft 42 (i.e., FIG. 2) that pivots the triangular truss rocker arms 38, 39. An elongated crankshaft 48 (i.e., FIG. 6) described further below, which supports the flywheel assembly, also extends between the stringers 30, 32.

The platform vibrator 20 comprises a generally planar rocker plate 36 (FIGS. 1, 3) disposed at the top of the apparatus within the upper confines of the skirt 28. The lightweight rocker plate 36 is preferably made of aircraft honeycomb material. A pair of unique, triangular truss rocker arms 38 and 39 are pivotally cradled between the neighboring stringers 30 and 32 respectively by a transverse rocker shaft 42. The driven ends 44 (FIG. 5) of both rocker arms 38, 39 are rotatably coupled to connecting rods 46 (FIGS. 3, 7) that are pivotally secured within and between the spaced-apart rocker arm hubs (i.e., FIG. 7). Crankshaft 48, which mounts a flywheel assembly 99 (i.e. FIGS. 6, 9) is journaled between stringers 30 and 32, terminates in eccentric stubs 52 (i.e., FIG. 7) at each of its ends. These stubs 52 are coupled to connecting rods 46 (FIGS. 2, 3, 7) described in more detail later for vigorously reciprocating ends 44 (i.e., FIG. 7) of the triangular truss rocker arms 38 and 39. This movement is illustrated by dashed lines in FIG. 5.

The rocker plate 36 (FIGS. 1, 3) is supported on and between the rocker arms 38 and 39. Plate 36 rests upon suitable, resilient strips 55 disposed on the top of each triangular truss rocker arm 38, 39 (i.e., FIGS. 2, 7). Plate 36 is secured to the rocker arms 38, 39 with suitable spaced apart fasteners 58 (FIGS. 1, 3). The upper, outer surface 60 (FIG. 1) of the rocker plate 36 provides support for a standing user whose feet may occupy the positions designated generally by the foot position markers 64, 66.

Figure 5:
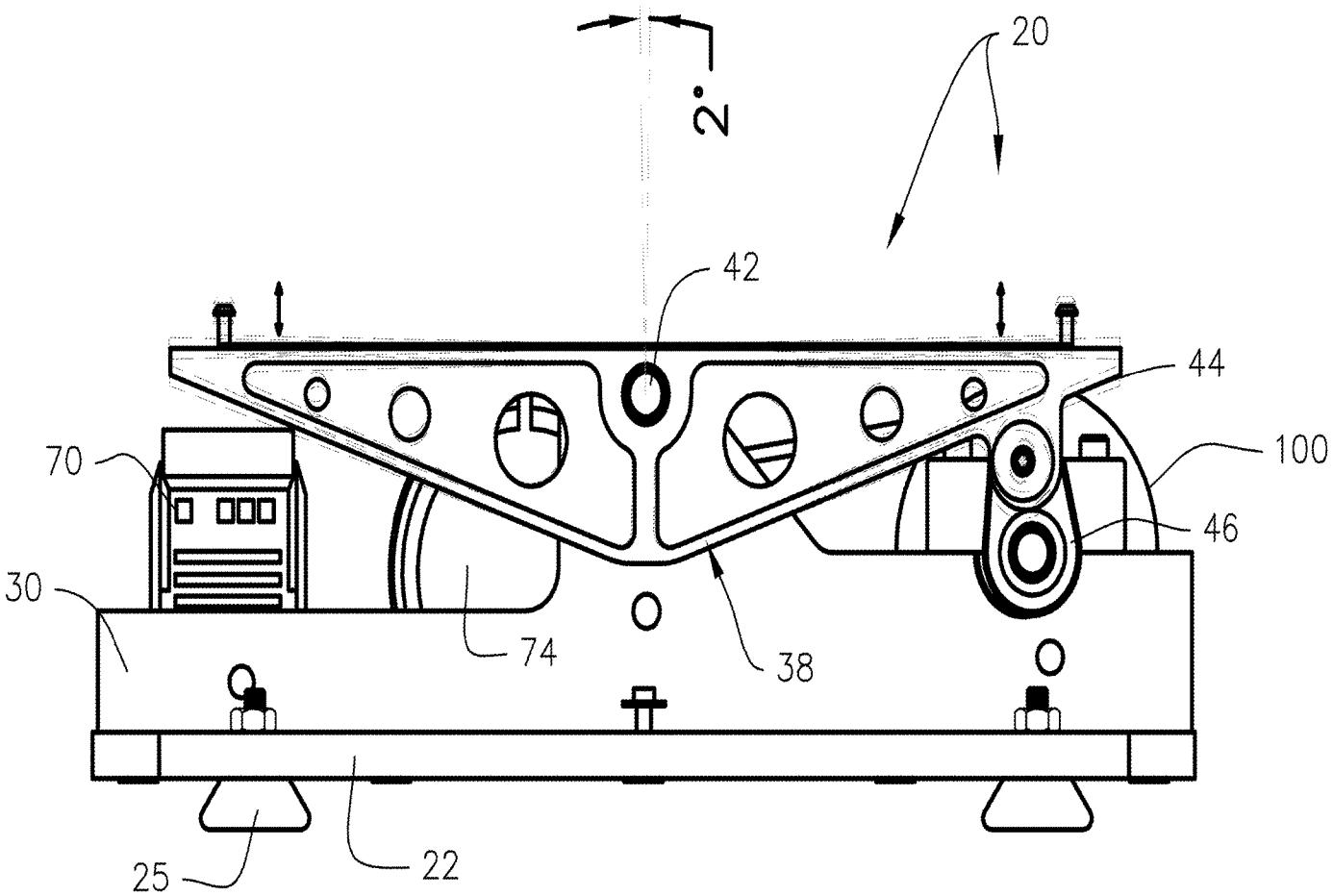
FIG. 5 is a front elevational diagrammatic view similar to FIG. 3, showing moved positions resulting from vibration in dashed lines.

Referencing FIGS. 3 and 5, there is a controller 70 of generally cubicle proportions disposed at the left side (i.e., as viewed in FIG. 3) of the platform vibrator 20. Control wiring (not shown) for operating controller 70 enters the vibrator 20 through the controller port 31 (FIG. 1) described above. Controller 70 is disposed between the triangular truss rocker arms 38 and 39, somewhat to the left (as viewed in FIG. 3) of a drive motor 74, which is secured between the opposed, parallel, stringers 30 and 32.

Figure 11:
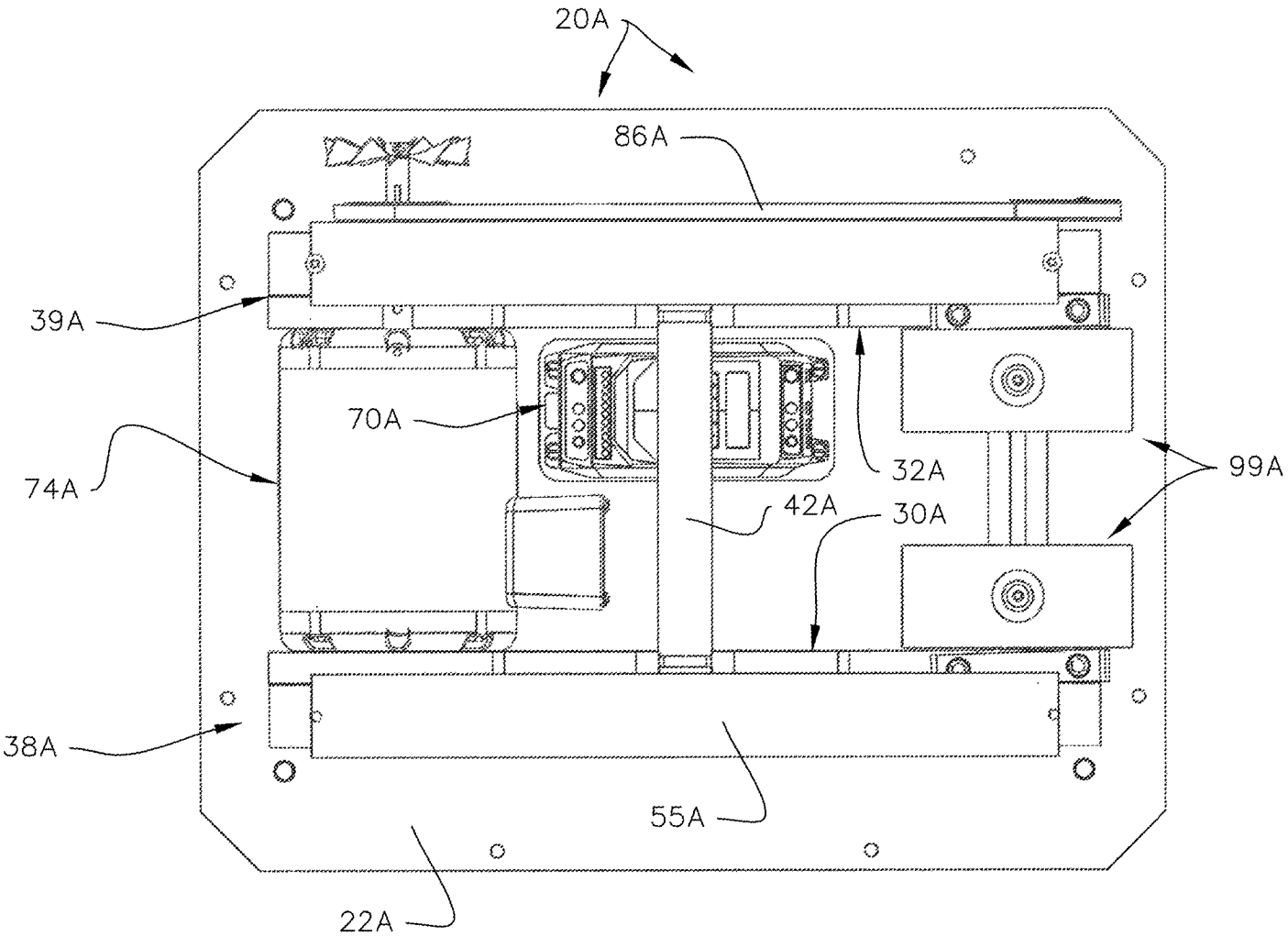

In some cases, as illustrated in FIG. 11, it is desirable to juxtaposition the motor and controller. In the alternative embodiment 20A (FIG. 11) the motor 74A is repositioned repositioned further to the left (i.e., to the position where the controller 70 is presently illustrated in vibrator 20). The motor 74A is disposed between parallel stringers 30A and 32A that are secured to base plate 22A. Motor 74A actuates drive belt 86A to rotate the flywheel assembly 99A. The rocker arms 38A and 39A are pivoted by rocker shaft 42A extending between the stringers 30A and 32A. Resilient strips 55A are disposed on the rocker arms 38A and 39A to support a lightweight, honeycomb rocker plate (not shown) that is similar to plate 36 already discussed. Controller 70A is relocated to a middle position beneath the rocker shaft 42A between the stringers 30A and 32A. The longitudinal axis of controller 70A is parallel with the stringers and rocker arms.

Figure 4:
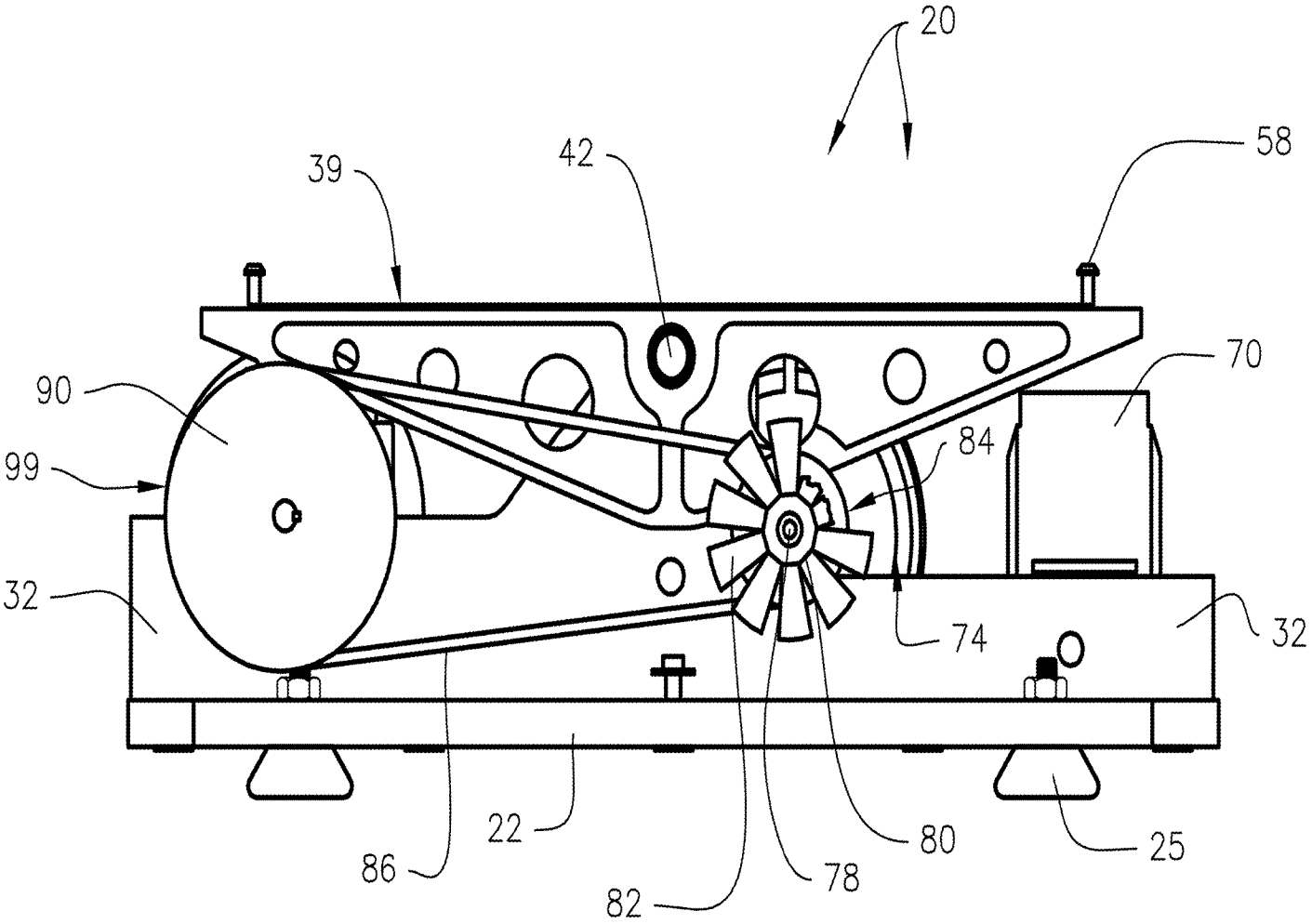
FIG. 4 is a fragmentary, rear elevational view taken generally along line 4-4 in FIG. 2.
Figure 8:
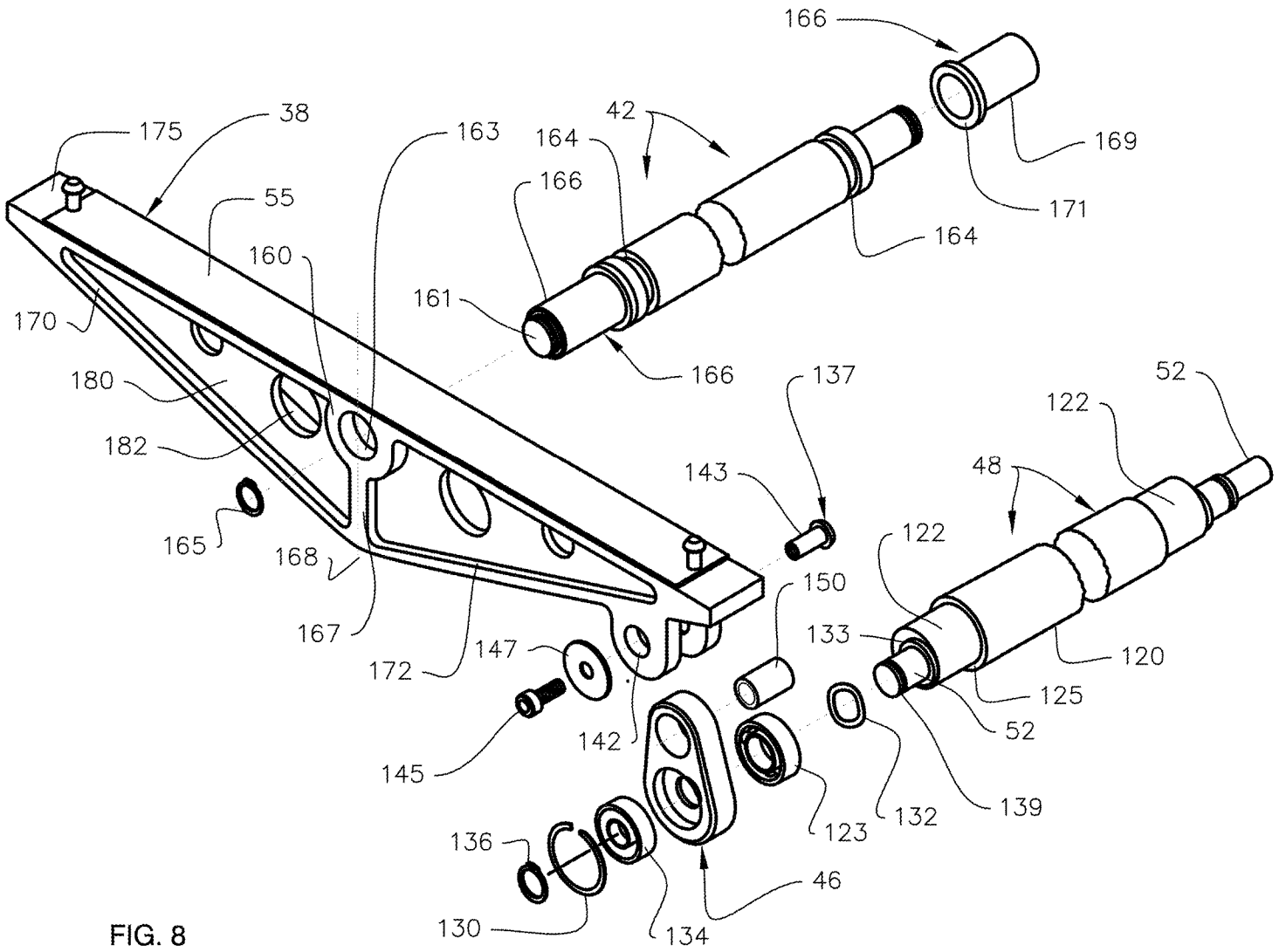
FIG. 8 is an enlarged, fragmentary exploded view showing a preferred triangular truss rocker arm and associated components.
Figure 9:
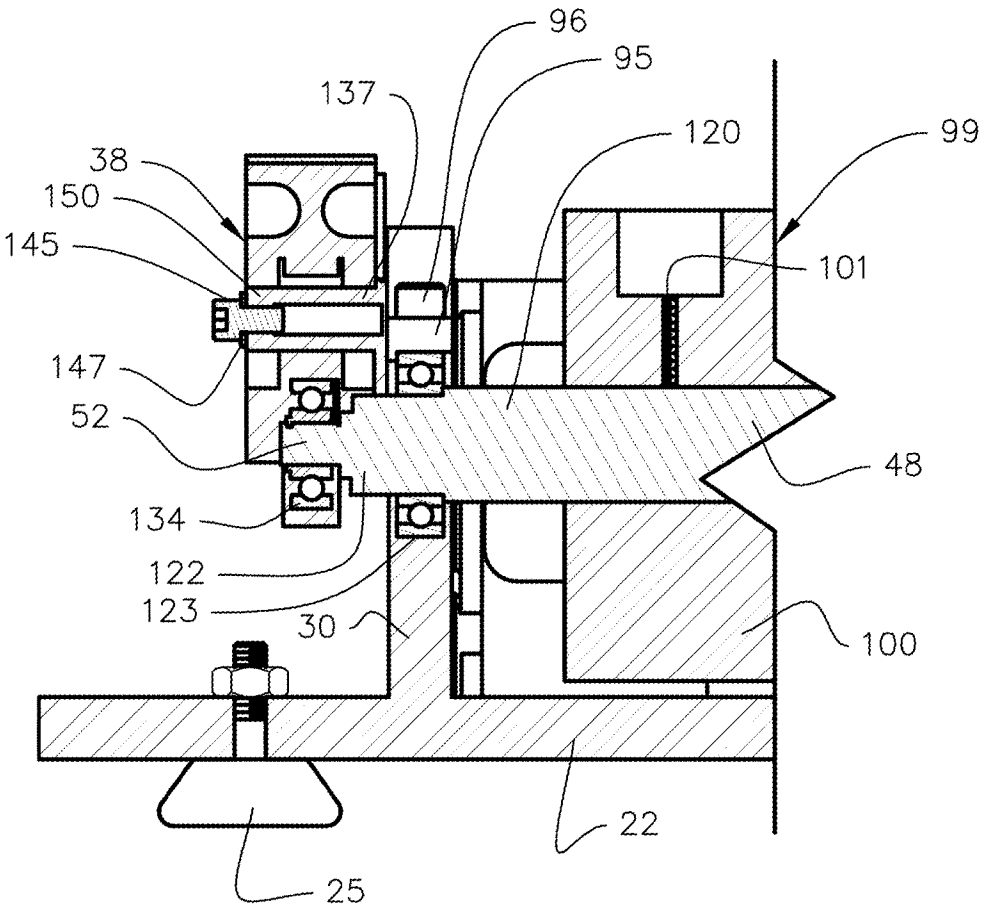
FIG. 9 is an enlarged, sectional view taken generally along line 9-9 in FIG. 2.
Figure 10:
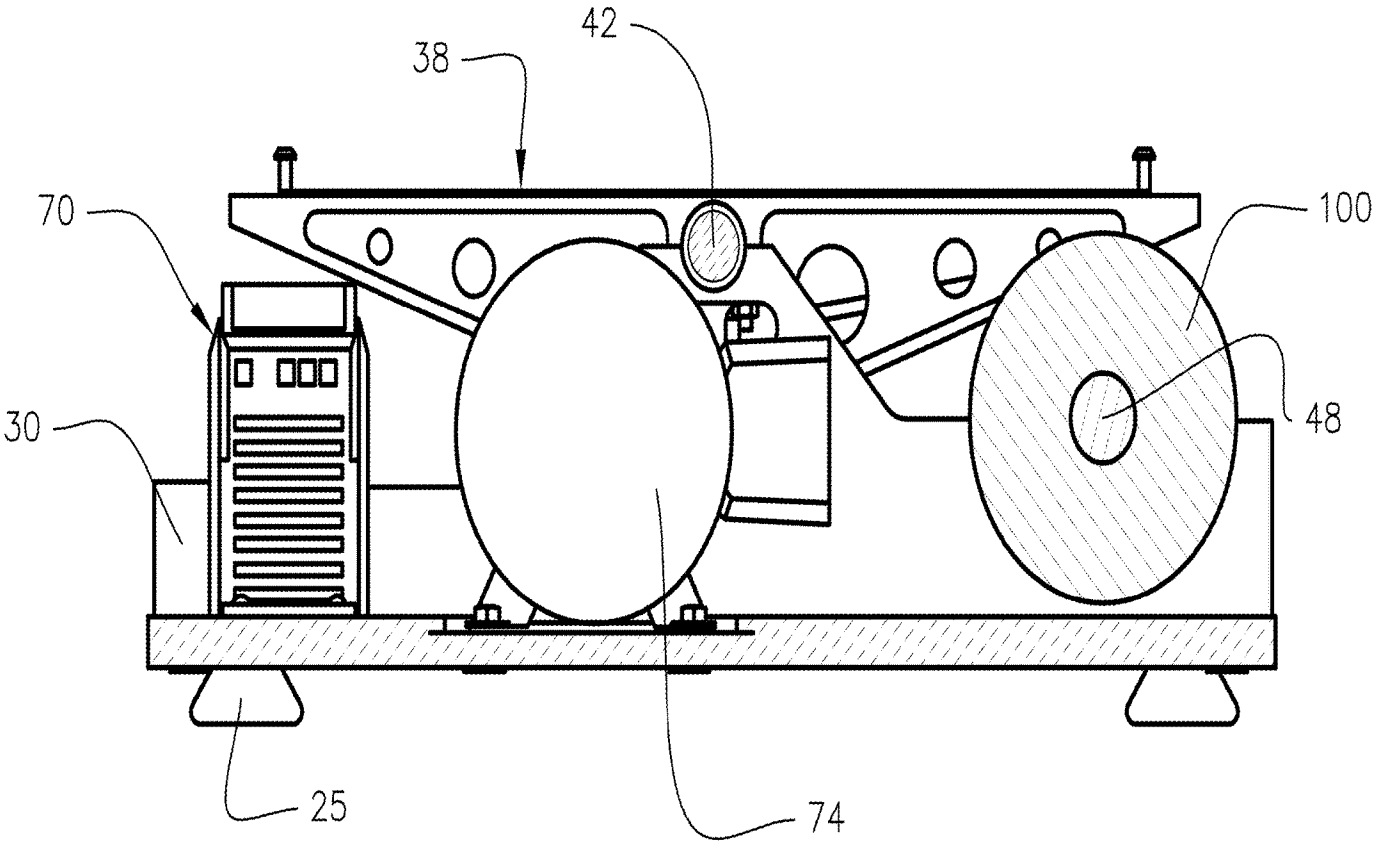
FIG. 10 is a sectional view taken generally along line 10-10 in FIG. 2; and, FIG. 11 is a top plan view of an alternative embodiment, wherein the motor and controller are repositioned.

As best viewed in FIG. 4, motor 74 has a driveshaft 78 passing over stringer 32 to the side of the vibrator. Driveshaft 78 supports a hub 80 that mounts a ventilation fan 82. A pulley 84 is splined to driveshaft 78 (FIGS. 4, 6) and rotates a drive belt 86 that is entrained over a larger diameter flywheel pulley 90 splined to crankshaft 48 (i.e., FIGS. 6, 8) for rotating the flywheel assembly 99. Crankshaft 48 extends between stringers 30 and 32 and rotatably supports flywheel assembly 99, which comprises separate flywheel portions 100 and 102, totaling a revolving weight of approximately fourteen kg. Flywheel weight is preferably matched to the expected loads or weight to be supported or encountered by the rocker plate 36 (FIG. 2) in operation. Each flywheel portion 100, 102 is secured to crankshaft 48 by a suitable Allen screw threadably seated within passageway 101 (FIG. 9). Pillow block cap 94 (FIG. 6) is secured to stringer 32 to secure the driveshaft 48 at the drive pulley side of the vibrator 20 (i.e., the right side of FIG. 6). Another pillow block cap 95 secures the crankshaft 48 at the left side, being secured to stringer 30. Caps screws 96 (FIG. 2) secure the pillow block caps 94, 95 to their respective stringers.

Figure 7:
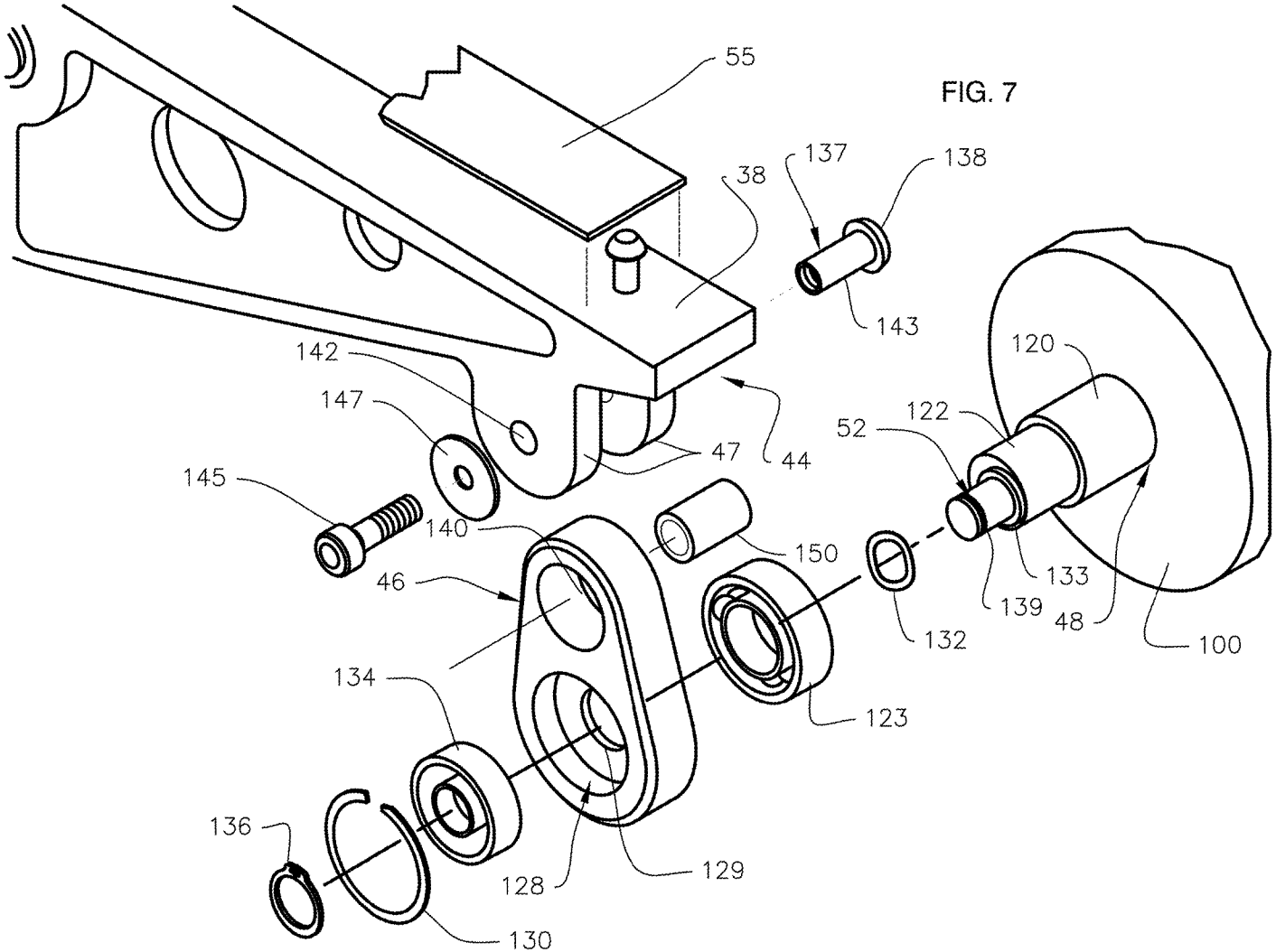
FIG. 7 is an enlarged, fragmentary, exploded view of the preferred connecting rod assembly derived from circled region "7" in FIG. 2.

As best viewed in FIG. 7, the crankshaft 48 comprises a shaft body with a main central portion 120 having integral, spaced-apart trunnions 122 defined on each end. The reduced diameter trunnions 122 coaxially project from both ends of the crankshaft 48 and are rotatably supported within suitable bearings 123 received within opposite, supporting cradles formed in the tops of stringers 30, 32, being retained by pillow block caps 95 and discussed earlier. Each trunnion 122 is journaled through a bearing 123 (i.e., FIGS. 7, 9) that contacts a shoulder 125. The pillow block caps contact the bearing 123 to retain it.

The companion bearings 134 (FIG. 7) associated with each of the connecting rods 46 are retained within a circular recess 128 defined in the bottom of each connecting rod 46. A snap ring 130 fits within suitable circumferential grooves defined in the perimeter of recess 128 to axially retain bearing 134 within the connecting rod recess. The eccentric stub 52 (FIG. 7) integrally projecting outwardly from each trunnion 122 penetrates central orifice 129 in recess 128 and rotatably receives and supports bearing 134, which is urged against a wave washer 132 that abuts integral shoulder 133 (FIGS. 7, 8). The eccentric stubs 52 (FIG. 7) oscillate the bearings 134 and the connecting rods 46 in which they are seated. As best viewed in FIGS. 7 and 9, the eccentric stub 52 terminates proximate the bearings 134 and receives a retaining snap ring 136 seated within groove 139.

The upper part of each connecting rod 46 is pivotally coupled to the triangular truss rocker arms, being sandwiched between the spaced apart, parallel rocker hubs 47 (FIG. 7). Each upper connecting rod orifice 140 is sandwiched in assembly between the twin, spaced-apart rocker arm hubs 47 in coaxial alignment with the orifices 142 (FIG. 7). A bearing sleeve 150 (FIG. 7) penetrates orifice 140 in connecting rod 46 and is aligned between hubs 47 with spaced-apart orifices 142. Each bearing sleeve 150 is axially maintained in position by a through-pin 137 whose head 138 abuts an exterior surface portion of a hub 47. The internally threaded shank 143 of pin 137 coaxially penetrates sleeve 150. Shank 143 is secured by a cap screw 145 that penetrates a washer 147 and orifice 142 adjacent a hub 47.

Jointly referencing FIGS. 2 and 8, the triangular truss rocker arms 38 and 39 each have a reinforced center boss 160 that rotatably receives the rocker shaft 42, which is journaled similarly to crankshaft 48 discussed above. Rocker shaft 42 is centered over the stringers and establishes a rocking point at the rocker arm centers. The ends 161 of rocker shaft 42 are provided with generally T-shaped (when viewed longitudinally) plastic bushings 166 that penetrate orifices 163 in boss 160. Each bushing 166 has a sleeve portion 169 and an integral head portion 171. Shaft ends 161 are engaged and retained by snap rings 165 (FIG. 8). A pair of U-clamps 162 (FIG. 2) secure the rocker shaft 42 within suitable cradles defined in tops of the stringers 30, 32. U-clamps 162 engage the ring grooves 164 (FIG. 8) defined in the ends of the rocker shaft 42 that border bushing heads 171.

As best seen in FIG. 8, the rocker arms 38 or 39 are preferably shaped like an inverted, isosceles triangle. Center boss 160 is integral with a central reinforcement 167 that projects to the vertex 168 which forms a junction between the left and right triangle legs 170, 172. In the best mode each of the legs 170, 172 extends angularly to ends of the integral, cross leg 175 forming the base or longest side of the triangle. Each of the legs 170, 172 and 175 is approximately one to two inches wide (with 1.5 inches width preferred). The thickness is preferably one-quarter inch. A central webbing 180 in the truss center provides reinforcement. A plurality of spaced apart orifices 182 defined in the rocker arm webbing 180 lighten weight.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A platform vibrator adapted to provide firm, sustained vibration, the platform vibrator comprising:

a generally planar base adapted to be disposed upon a supporting surface;

a generally planar rocker plate disposed above said generally planar base;

a pair of spaced apart, rigid triangular truss rocker arms that support said generally planar rocker plate;

a flywheel assembly;

a motor for driving said flywheel assembly to operate said vibrator;

a rocker shaft for pivoting the triangular truss rocker arms;

the triangular truss rocker arms each comprising a reinforced center boss that rotatably receives the rocker shaft;

an elongated crankshaft supporting and rotating the flywheel assembly;

connecting rod means for connecting said elongated crankshaft to said triangular truss rocker arms;

a pair of rigid, parallel stringers disposed upon said generally planar base and rising vertically therefrom; and, wherein the rocker shaft is rotatably secured between said pair of stringers within rotation-enabling cradles defined in tops of the stringers.

2. The platform vibrator as defined in claim 1 further comprising an upright, encircling, skirt supported peripherally about the generally planar base forming an enclosure.

3. The platform vibrator as defined in claim 2 wherein the triangular truss rocker arms each have a single driven end coupled to said connecting rod means.

4. The platform vibrator as defined in claim 3 wherein each triangular truss rocker arm driven end comprises a pair of spaced-apart rocker arm hubs that pivotally receive said connecting rod means.

5. The platform vibrator as defined in claim 4 wherein the elongated crankshaft terminates at a pair of opposite ends in eccentric stubs for reciprocating the connecting rods and driving the triangular truss rocker arms.

6. The platform vibrator as defined in claim 1 wherein the generally planar rocker plate rests upon resilient strips disposed on a top of each triangular truss rocker arm.

7. The platform vibrator as defined in claim 6 wherein the rocker arms have an inverted isosceles triangle shape.

8. A platform vibrator adapted to provide firm, sustained vibration, the platform vibrator comprising:

a rigid, generally planar base adapted to be disposed upon a supporting surface;

a pair of rigid, spaced apart, parallel stringers disposed upon said generally planar base that rise vertically therefrom;

a rigid, generally planar rocker plate disposed above said pair of stringers and said generally planar base;

a pair of spaced apart, rigid triangular truss rocker arms that support said generally planar rocker plate;

a flywheel assembly;

a motor for driving said flywheel assembly to operate said vibrator;

a transversely mounted rocker shaft extending between said pair of stringers that pivots the triangular truss rocker arms;

an elongated crankshaft supporting and rotating the flywheel assembly, the crankshaft comprising integral, spaced-apart trunnions defined on each end that are rotatably supported within rotation-enabling bearings received within opposite, supporting cradles formed in said pair of stringers;

connecting rod means for connecting said elongated crankshaft to said triangular truss rocker arms; and, wherein the crankshaft comprises eccentric stubs proximate said trunnions for reciprocating the connecting rod means and driving the triangular truss rocker arms to vibrate said generally planar rocker plate.

9. The platform vibrator as defined in claim 8 wherein:

each triangular truss rocker arm has a single driven end; and, each triangular truss rocker arm driven end comprises a pair of spaced-apart rocker arm hubs that pivotally receive said connecting rod means.

10. The platform vibrator as defined in claim 9 wherein the triangular truss rocker arms each have a reinforced center boss that rotatably receives the rocker shaft.

11. The platform vibrator as defined in claim 10 wherein the rocker shaft is secured to said pair of stringers within rotation-enabling cradles defined in tops of the pair of stringers.

12. The platform vibrator as defined in claim 8 wherein the triangular truss rocker arms have an inverted isosceles triangle shape.

* * * * *